US006792850B2

(12) United States Patent
Scheucher et al.

(10) Patent No.: US 6,792,850 B2
(45) Date of Patent: Sep. 21, 2004

(54) SCREW PRESS

(75) Inventors: Peter Scheucher, Kumberg (AT); Rudolf Stadlauer, Eggersdorf (AT)

(73) Assignee: Andritz AG, Graz (AT)

( * ) Notice: Subject to any disclaimer, the term of this patent is extended or adjusted under 35 U.S.C. 154(b) by 0 days.

(21) Appl. No.: 10/287,848

(22) Filed: Nov. 5, 2002

(65) Prior Publication Data

US 2003/0126999 A1 Jul. 10, 2003

(30) Foreign Application Priority Data

Nov. 8, 2001 (AT) ..... 1758/2001

(51) Int. Cl.[7] ..... B30B 9/06

(52) U.S. Cl. ..... 100/127; 100/128; 100/131; 100/145; 100/117

(58) Field of Search ..... 100/110, 112, 100/117, 126, 127, 128, 131, 132, 145

(56) References Cited

U.S. PATENT DOCUMENTS 3,585,924 A * 6/1971 Nolan ..... 100/43
4,155,299 A * 5/1979 Tuttle ..... 100/117
4,323,007 A * 4/1982 Hunt et al. ..... 100/37
5,215,007 A * 6/1993 Sebright et al. ..... 100/45
5,231,922 A * 8/1993 Hartmann ..... 100/37
5,566,611 A * 10/1996 Scheucher et al. ..... 100/127
5,857,406 A * 1/1999 Scheucher et al. ..... 100/112
6,071,378 A * 6/2000 Saito ..... 162/58
6,588,331 B2 * 7/2003 Thibodeau ..... 100/112

* cited by examiner

*Primary Examiner*—Ed Tolan
(74) *Attorney, Agent, or Firm*—Alix, Yale & Ristas, LLP

(57) ABSTRACT

The invention relates to a screw press for separating liquids from solid-liquid mixtures, especially pulp suspensions, which has a casing provided with liquid passages, especially divided into segments, a screw rotating inside the casing, a shaft, preferably hollow, and a suspension feed area. It is primarily characterised by a filtrate shell 3 being provided directly at one or several screen baskets 2, 2' and by discharge openings 6, 10 being provided in the lower part of the shell 3.

17 Claims, 7 Drawing Sheets

SCREW PRESS

BACKGROUND OF THE INVENTION

The invention relates to a screw press for separating liquids from solid-liquid mixtures, especially pulp suspensions, which has a casing provided with liquid passages, especially divided into segments, as well as having a screw rotating inside the casing, a shaft, preferably hollow, and a suspension feed area.

It is known that screw presses with a large diameter are not easy to fill evenly because the pressure in the screw press increases further down in the feed area in accordance with the diameter (height). This means that the pressure on the screen is, for example, approximately 0.14 bar higher at the bottom than at the top. With some pulps to be dewatered, which have a low inlet consistency, the differential pressures applied should not exceed 0.05 bar. At higher pressures, the screens become clogged with pulp and this screen surface is lost for dewatering purposes. Particularly with large screw press diameters, additional pressure is needed in the feed area in order to distribute the pulp to be dewatered in the screw press forwards. With pulps that are difficult to dewater, it is often only possible to use a small percentage (e.g. less than 50%) of the screen surface of screw presses with a large diameter compared with that used in screw presses with a small diameter. A possible solution is known, for example, from DE 19715173. This solution, however, has the disadvantage of heavy fine particles contained in the filtrate (e.g. ash) settling in the tray and thus covering the base of the tray, which means that the submerged screen surface again is not utilised.

SUMMARY OF THE INVENTION

The aim of the invention is to eliminate this disadvantage and to provide a screw press that can also be utilised in full, even with a large diameter. This is achieved by a filtrate shell being provided directly at one or several screen baskets and by discharge openings being provided in the lower part of the shell. The filtrate can drain off through these openings into the existing filtrate tray or into a collecting pipe. Thus, clogging of the lower screen surface is largely avoided.

An advantageous configuration of the invention is characterised by the filtrate shell being divided into several zones. With this arrangement it is not only possible to maintain the differential pressure at a constant level, but also to set any desired pressure difference in longitudinal direction inside the screw press.

An advantageous further development of the invention is characterised by the individual zones having filtrate overflows at different heights. In this way, a compression curve setting for the screw press can be corrected easily and the screw press adapted to pulps with different dewatering behaviour.

An advantageous further development of the invention is characterised by the discharge openings being formed as discharge holes and by slide valves being provided at these discharge holes to set the drainage cross-section. With this slide valve the cross-section of the discharge holes for the maximum throughput of the screw press can be set such that the desired liquid level is always obtained in the filtrate tray.

A favourable further development of the invention is characterised by the filtrate tray having filtrate overflows. As a result, the maximum retaining height and thus, the maximum counter-pressure can be set in addition.

A favourable configuration of the invention is characterised by the entire screen basket being surrounded by a filtrate tray in the feed area up to the medium-pressure area, where at least one discharge connection is provided as discharge opening and a throttle valve can be provided for setting the pressure. With this arrangement, the differential pressure can be maintained absolutely constant over the full height in the entire low and medium pressure areas of the screw press.

A favourable configuration of the invention is characterised by the throttle valve being connected to a differential pressure control unit (screen inside/outside). Thus, the inlet pressure can be used to build up a pressure difference in longitudinal direction within the screw press to optimise the compression curve.

BRIEF DESCRIPTION OF THE DRAWINGS

The invention will now be described in examples on the basis of the drawings, where.

DESCRIPTION OF THE PREFERRED EMBODIMENT

Figure 1:
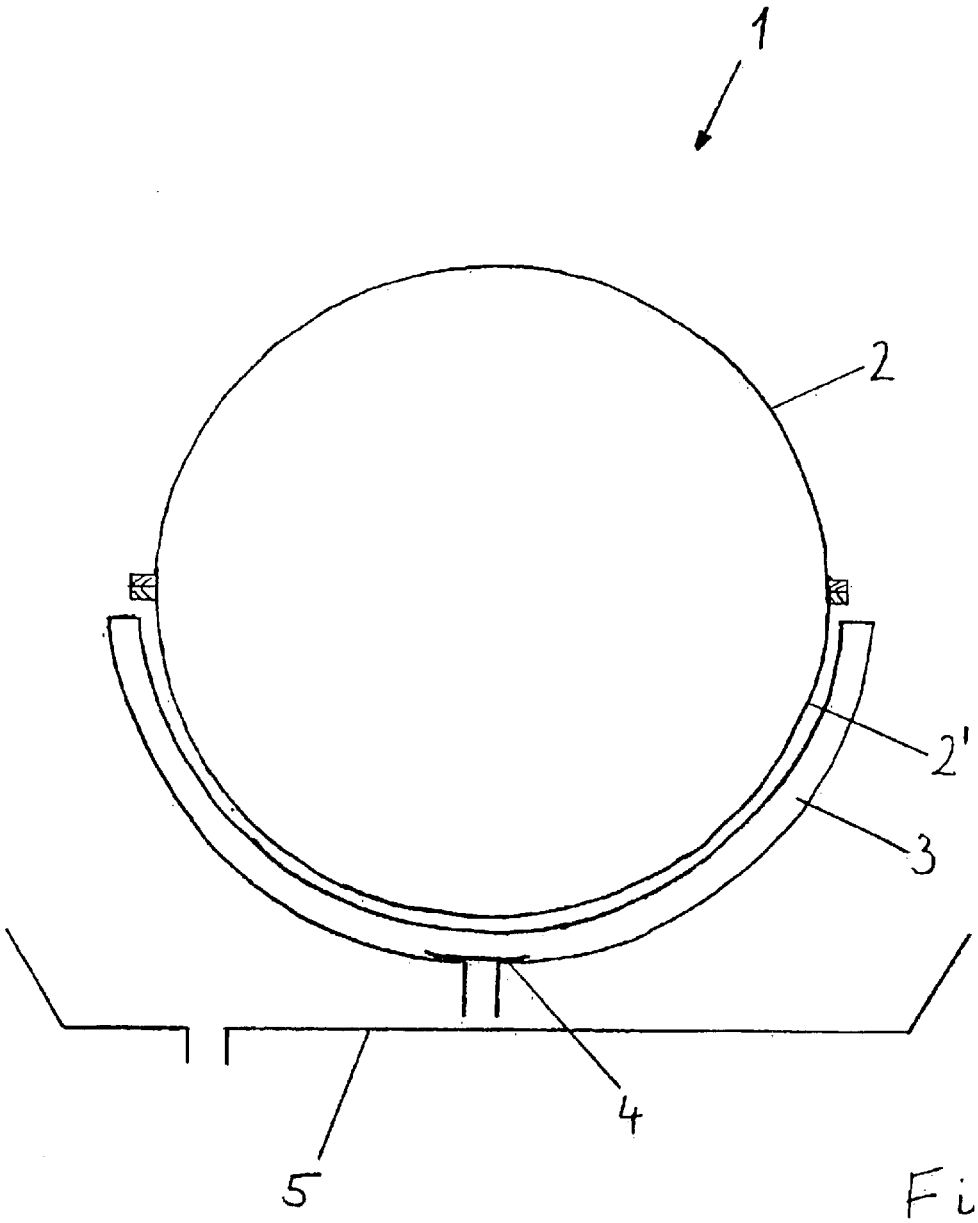
FIG. 1 shows a cross-section through the screen basket and filtrate tray according to an initial design of the invention.

FIG. 1 shows a cross-section of a screw press 1 according to the invention. This illustration shows the screen basket 2 and the lower part of the basket 2'. A filtrate tray 3 is mounted round the lower part of the screen basket 2'. The individual segments of the filtrate tray 3 are bolted together with flanges. In the lower section of the filtrate tray 3 there is a slide 4 with holes (not shown here). This can be used to set various overlaps with the holes in the filtrate tray 3. Beneath the screen basket 2, 2' and the filtrate tray 3 there is a further open filtrate or collecting tray 5.

Figure 2:
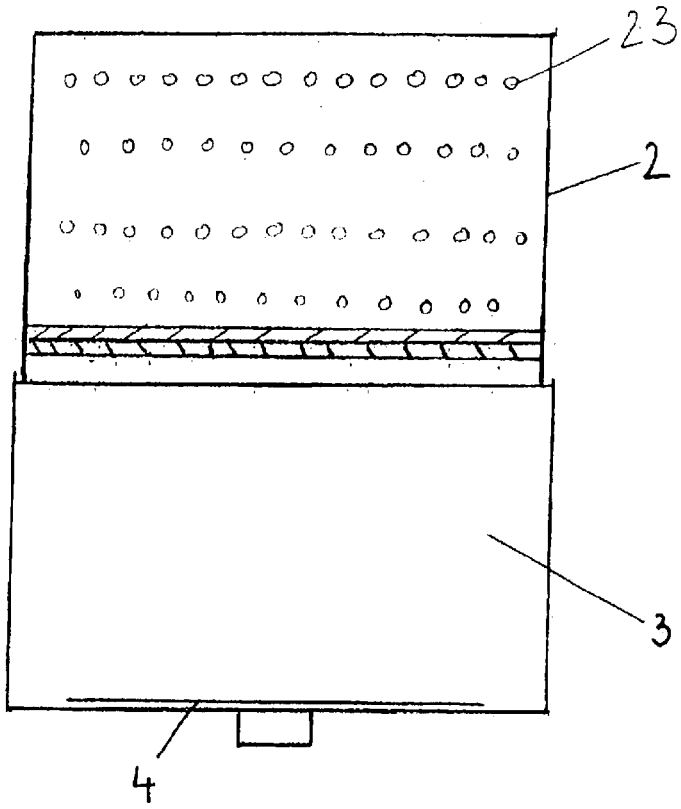
FIG. 2 shows a view of a segment according to FIG. 1.

FIG. 2 shows a side view of a segment of the screw press with screen basket 2 and liquid passage 23 therein (lower section 2' of screen basket is covered over), filtrate tray 3 and slide valves 4 movable in the axial direction of the press.

Figure 3:
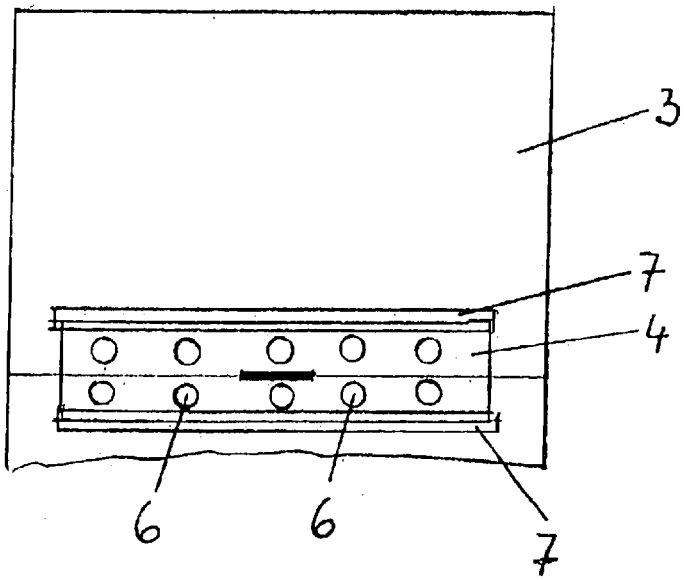
FIG. 3 contains a developed view of the outer shell of the filtrate tray.

FIG. 3 contains a developed view of the sheet metal forming the filtrate tray 3. In this view it is easy to see the slide valve 4 that opens the holes 6 in the filtrate tray 3 in the position illustrated. The slide valve 4 can be pushed back and forth on strips 7 in the axial direction, thereby setting the required drainage cross-section (open area) of the holes 6.

Figure 4:
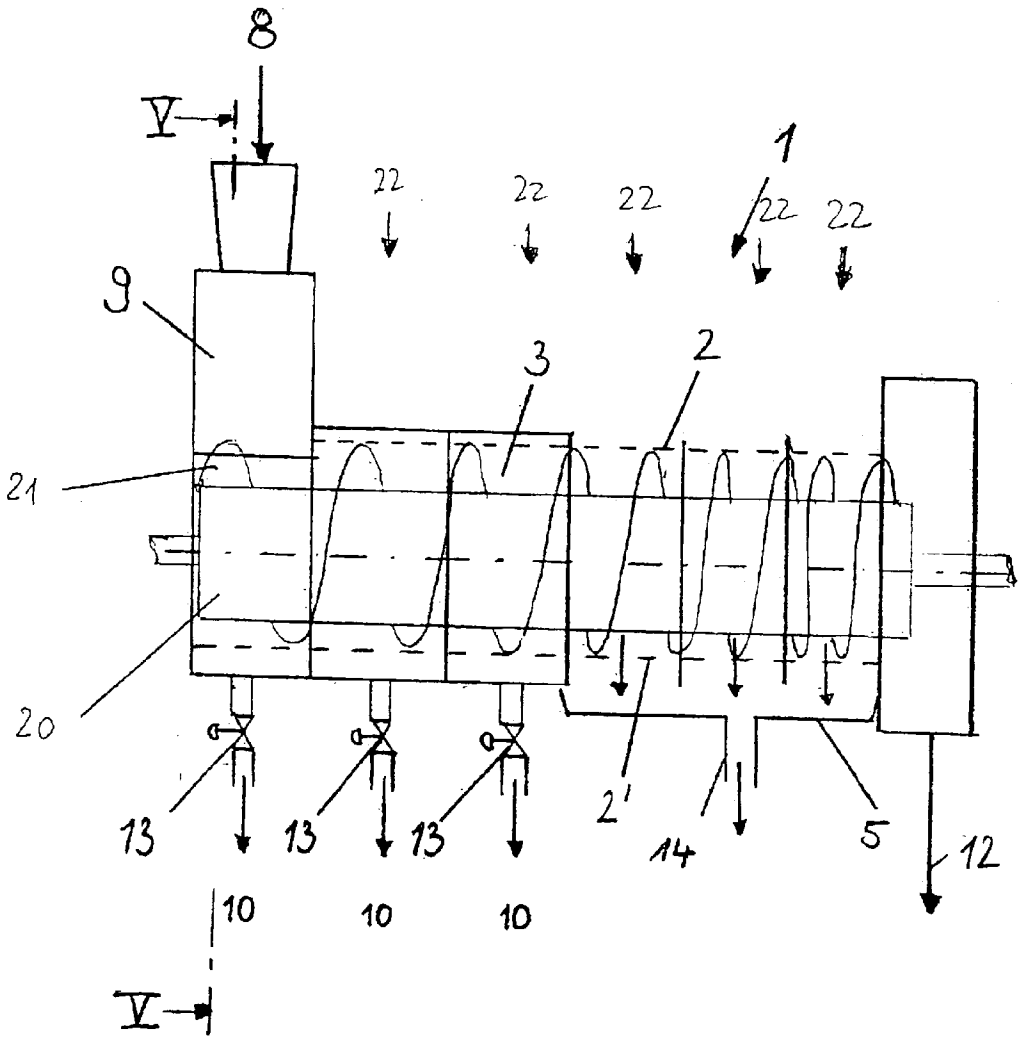
FIG. 4 shows a screw press according to a further variant of the invention.

FIG. 4 shows a side view of the press having a screw 21 carried on a hollow, rotatable shaft 20, illustrating a further variant of the invention. The screw press 1 has a screen basket 2, 2'. The screen basket 2 is divided into segments which, together with the respective shells 3 form zones 22. Preferably, the axial length of a basket and its respective shell are substantially equal. The shell is divided into these zones so that the mounting and maintenance will be easy. In the front segments of the low-pressure area this screen basket 2,2' is entirely surrounded by a filtrate tray 3. The suspension of pulp to be dewatered, for example fibre pulp or chemical pulp, is fed into the inlet section 9 at 8. The filtrate from the first segments in the low-pressure area then drains off separately at 10, where the flow rate through each discharge pipe 10 can be set separately using a valve 13. The individual valves 13 can be set such as to adapt the compression curve of the screw press to the pulp to be dewatered. The filtrate from the medium-pressure and high-pressure zones flows into a collecting tray 5 and drains off through a discharge point 14. The dewatered pulp is discharged from the screw press 1 at discharge end 12.

Figure 5:
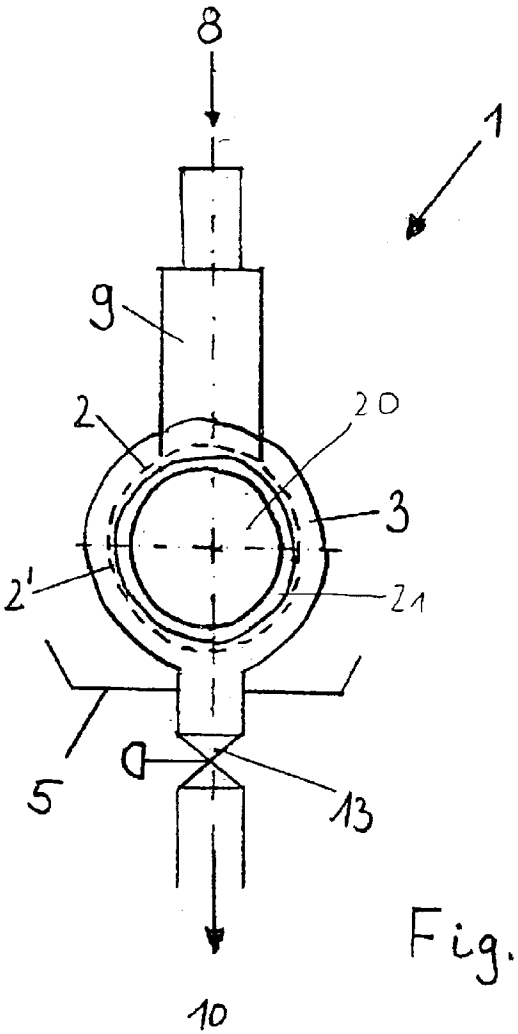
FIG. 5 contains a sectional view through FIG. 4.

FIG. 5 shows a section along the line marked V—V in FIG. 4. This shows the inlet 9 for the suspension 8. In addition, this figure shows the screen 2, 2', the fully enclosed filtrate tray 3, and the discharge points 10 with valve 13. At the inlet, the pressure prevailing is $p_e$ and the valve generates a counter-pressure of $p_s$.

Figure 6:
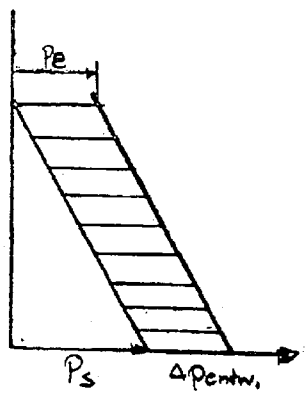
FIG. 6 illustrates the pressure distribution according to FIG. 5.

FIG. 6 illustrates the pressure progression over the height and the diameter of the screw press. At the inlet, the prevailing pressure is $p_e$, and the counter-pressure $p_s$ is set at the other end. This is achieved such that the differential pressure $\Delta p_{entw}$ for dewatering is constant over the entire height/diameter.

Figure 7:
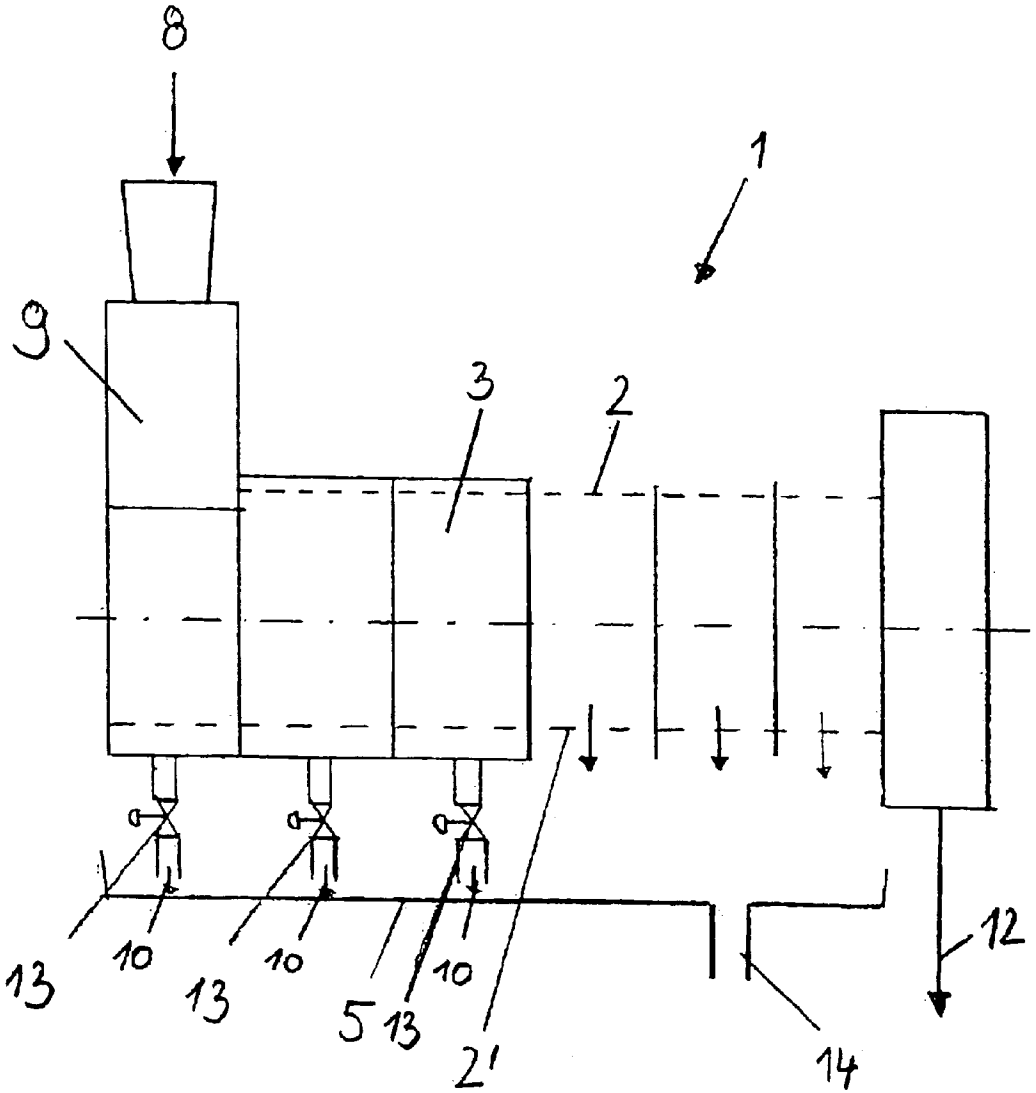
FIG. 7 shows an alternative variant of the invention analogous to FIG. 4.

FIG. 7 shows a variant of the invention as an alternative to FIG. 4. Here, the filtrate draining off individually through the discharge pipes 10 at the first segments is also brought to the collecting tray 5, which thus extends virtually over the entire length of the screw press 1.

Figure 8:
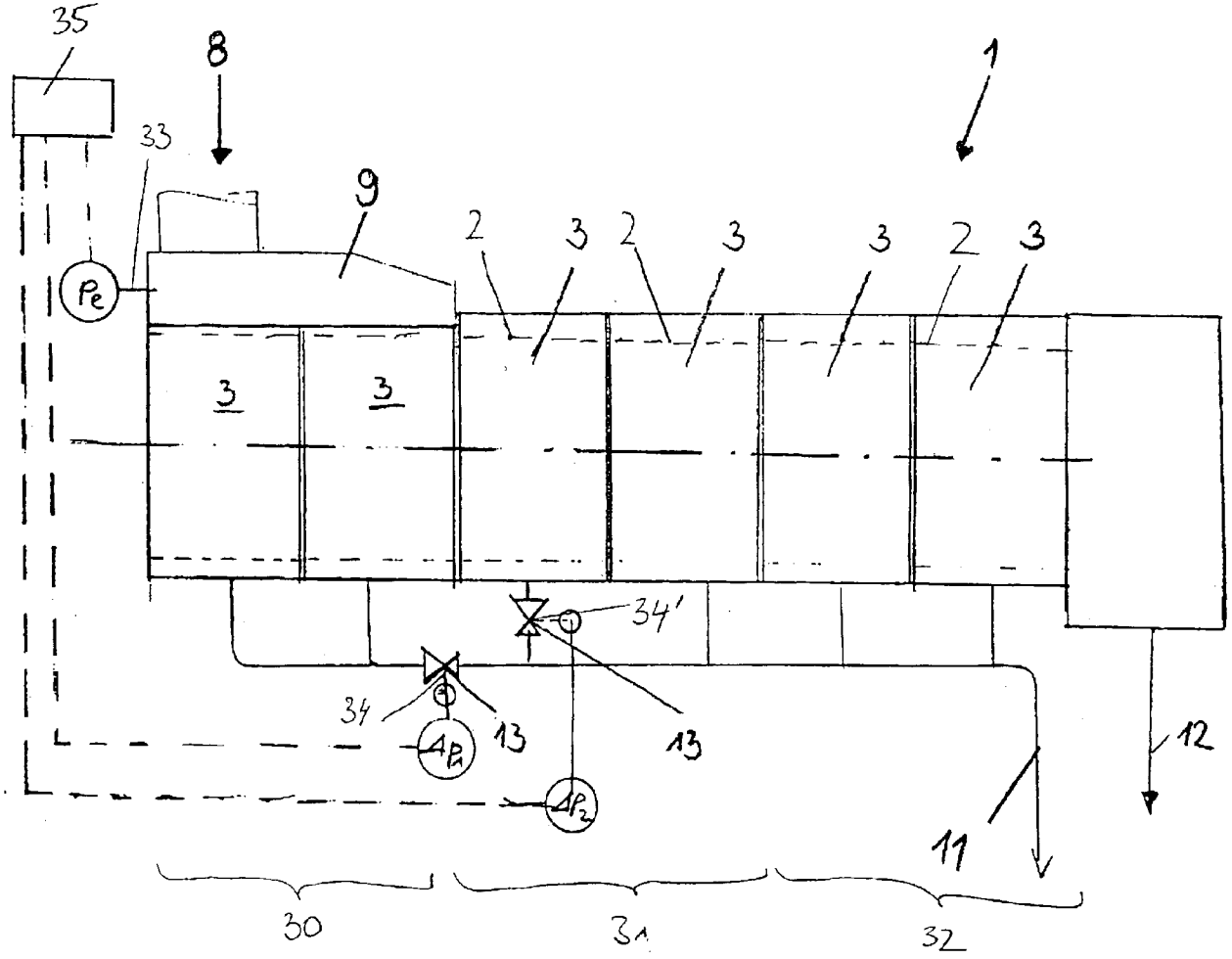
FIG. 8 provides a diagrammatic view of a further variant of the invention.

FIG. 8 shows a diagrammatic view, where all segments are completely surrounded by a filtrate tray 3. The filtrate is drained off through a joint collecting pipe 11. Brackets 30 are shown for the low pressure region, 31 for the medium pressure region and 32 for the high pressure region, always combining the segments and shells 3 of two zones. The regions however may also only comprise one zone or more than two zones depending on the properties of the product to be dewatered. The different pressure is gained by different slope of the screw. In addition FIG. 8 also shows a pressure sensor 33 in the inlet 9 of the screw press 1 and sensors 34 and 34' incorporated in or close to the drainage valves. The pressure control unit 35 assures that the necessary differential pressures $\Delta p_1$ and $\Delta p_2$ are maintained. This figure also shows how a valve 13 is used jointly for the first two segments, and a further valve 13 for the next segment. The remaining segments, preferably in the high-pressure sector, dewater directly into the collecting pipe 11. Of course, other segments can also be combined and controlled with one joint valve. It is also possible, however, to provide a separate valve for each segment.

Figure 9:
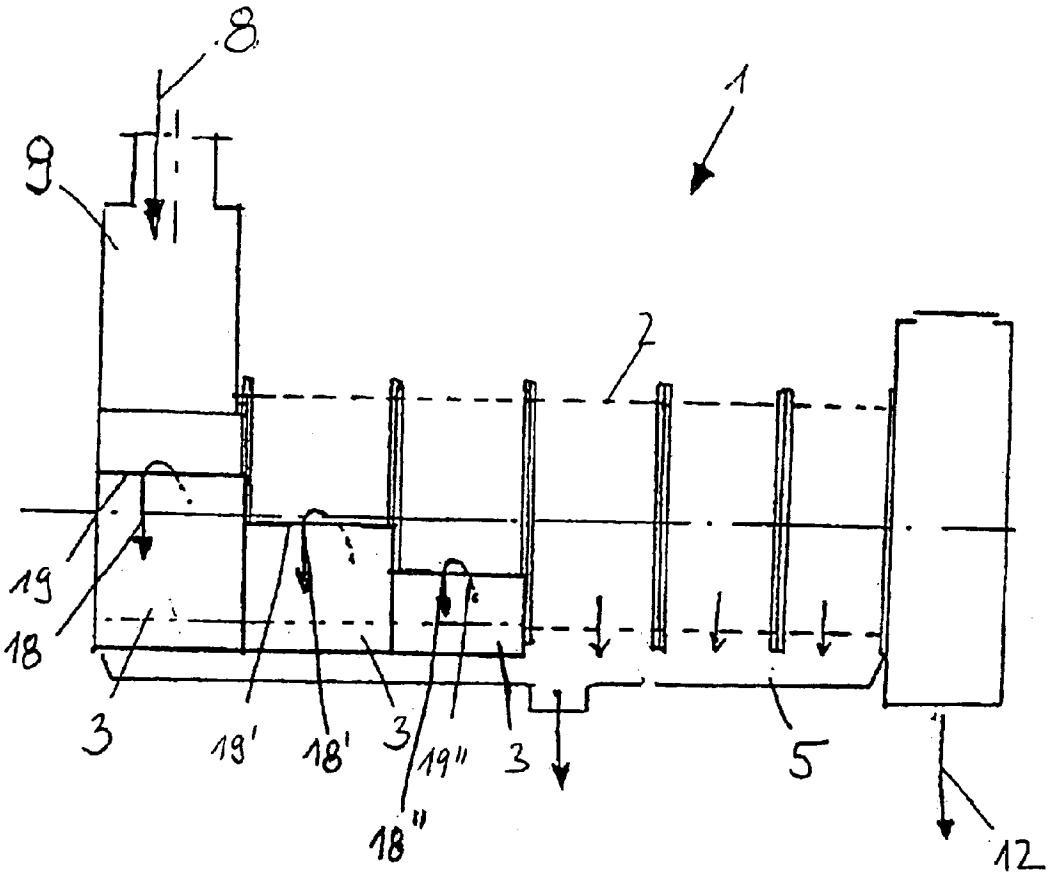
FIG. 9 shows a variant with consecutive shells having different heights.

FIG. 9 shows the variant with shells 3 with different heights 19, 19', 19" and the respective overflows 18, 18', 18" into the tray 5. Due to the different heights of the opposite ends of the shell, as spaced apart transversely to the press axis, different heights permit adjusted different differential pressures in the different zones. The individual shell segments can be considered arcs of a circle that vary in angular span from about 90 degrees to about 270 degrees (as measured from the press axis).

What is claimed is:

1. A screw press for separating liquids from solid-liquid mixtures, comprising:

a screw basket provided with liquid passages;

a screw rotatable inside the basket about a press longitudinal axis to dewater and advance the solids from a feed end to a discharge end of the press;

means for collecting filtrate from the screen basket and draining the filtrate from below the press;

a filtrate shell closely spaced around at least a portion of the screen basket, and having discharge openings situated adjacent the means for collecting filtrate and substantially vertically below the press axis; and means for controlling the flow of the filtrate to be discharged through said discharge openings to said means for collecting.

2. A screw press according to claim 1, wherein the filtrate shell is in the form of an arc of a circle spanning an angular range of between 90 and 270 degrees, as viewed along the press axis.

3. A screw press according to claim 1, wherein the press includes a plurality of distinct filtrate shell segments arranged consecutively along the press axis.

4. A screw press according to claim 1, wherein at least one distinct shell segment completely surrounds the screen basket and at least one other distinct shell segment is situated below the screen basket and spans an angle in the range of about 90–270 degrees as measured from the press axis.

5. A screw press according to claim 4, wherein a plurality of consecutive shell segments are provided along the press axis, each shell segment having an elevation defined by opposite ends spaced apart transversely to the press axis.

6. A screw press according to claim 1, wherein the press has a low pressure region immediately following the feed end, a high pressure region immediately upstream of the discharge end, and a medium pressure region between the low pressure region and the high pressure region, and each of said regions has a different configuration of filtrate shell selected from the group of variables consisting of the presence or absence of a shell, the angular extent to which the shell spans the basket as measured from the press axis, and the cross-sectional flow area of the discharge openings.

7. A screw press according to claim 3, wherein the screen basket comprises a plurality of distinct basket segments arranged consecutively along the press axis.

8. A screw press according to claim 7, wherein each filtrate shell segment has an axial length, each screen basket segment has an axial length, and wherein the axial length of each filtrate shell segment that is closely spaced around at least a portion of a screen basket segment, has the same axial length as said closely spaced screen basket segment.

9. A screw press according to claim 1, wherein the discharge openings are formed as discharge holes at the bottom of the filtrate shell, and a slide valve is provided at the discharge holes to adjust the drainage cross section therethrough.

10. A screw press according to claim 6, wherein the screen basket in the low pressure region of the press, is circumferentially surrounded by a filtrate shell.

11. A screw press according to claim 9, wherein the means for collecting filtrate include at least one discharge connection provided at the discharge opening of the slide valve, and a throttle valve is provided in the discharge connection for adjusting the pressure of the fluid in the space between the filtrate shell and the screen basket.

12. A screw press according to claim 11, wherein the throttle valve is operatively connected to a screen pressure control unit.

13. A screw press according to claim 1, further including a pressure control unit having a sensor responsive to the pressure between a screen unit and the fluid inlet pressure.

14. A screw press according to claim 6, wherein said low pressure region has at least two shell segments, said medium pressure region has at least two shell segments, and said high pressure zone has at least two shell segments.

15. A screw press according claim 1, including a pressure sensor situated at the feed end of the press;

a pressure sensor situated in the means for draining, responsive to pressure in the low pressure region;

a pressure sensor situated in the means for draining, responsive to pressure in the medium pressure region; and a differential pressure control unit, for maintaining a predetermined pressure differential between the low pressure region and the medium pressure region.

16. A screw press according to claim 1, wherein a plurality of filtrate shells are provided along the press axis, each shell situated below the screen basket and spanning an angle in the range of about 90–270 degrees as measured from the press axis.

17. A screw press according to claim 16, wherein at least two filtrate shells have different span angles.

* * * * *